US009624054B2

(12) United States Patent
Iino

(10) Patent No.: US 9,624,054 B2
(45) Date of Patent: Apr. 18, 2017

(54) IMAGE FORMING APPARATUS

(71) Applicant: Brother Kogyo Kabushiki Kaisha, Nagoya (JP)

(72) Inventor: Hikaru Iino, Niwa-gun (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/805,887

(22) Filed: Jul. 22, 2015

(65) Prior Publication Data

US 2016/0039625 A1 Feb. 11, 2016

(30) Foreign Application Priority Data

Aug. 8, 2014 (JP) ..... 2014-162636

(51) Int. Cl.

| | |
|---|---|
| ***B65H 9/04*** | (2006.01) |
| ***B65H 5/06*** | (2006.01) |
| ***B65H 7/02*** | (2006.01) |
| ***B65H 9/00*** | (2006.01) |

(52) U.S. Cl.

CPC ..... *B65H 5/062* (2013.01); *B65H 7/02* (2013.01); *B65H 9/006* (2013.01); *B65H 2511/30* (2013.01); *B65H 2513/53* (2013.01); *B65H 2601/121* (2013.01)

(58) Field of Classification Search

CPC ..... B65H 9/004; B65H 9/006; B65H 9/106; B65H 9/166

USPC ..... 271/226–228, 242–246

See application file for complete search history.

(56) References Cited

U.S. PATENT DOCUMENTS 8,585,038 B2 * 11/2013 Okano ..... B65H 9/006 271/242
8,948,682 B2 * 2/2015 Abe ..... G03G 15/234 399/401
2006/0051145 A1 * 3/2006 Ubayashi ..... B65H 5/34 399/395
2006/0268093 A1 * 11/2006 Kobayashi ..... G03G 15/6564 347/116

(Continued)

FOREIGN PATENT DOCUMENTS

JP S62-185655 A 8/1987
JP 2000-159395 * 6/2000

(Continued)

OTHER PUBLICATIONS

Machine translation of JP2000-159395.*

*Primary Examiner* — Thomas Morrison
(74) *Attorney, Agent, or Firm* — Burr & Brown, PLLC

(57) ABSTRACT

An image forming apparatus including an image forming unit, a conveyance roller, a registration roller disposed on a conveyance path extending from the conveyance roller to the image forming unit, the registration roller being configured to perform skew correction for a sheet by contacting a leading end of the sheet in a conveyance direction while rotation of the registration roller is being stopped, and rotating after a lapse of a particular period of time since the rotation of the registration roller has been stopped, a driving source configured to supply a driving force to the conveyance roller and the registration roller, and a controller configured to determine the particular period of time based on a cumulative number of sheets conveyed by the conveyance roller.

12 Claims, 5 Drawing Sheets

(56) References Cited

U.S. PATENT DOCUMENTS

| | | | | |
|---|---|---|---|---|
| 2013/0032994 | A1* | 2/2013 | Okano | B65H 9/006<br>271/226 |
| 2013/0195532 | A1* | 8/2013 | Abe | G03G 15/234<br>399/401 |

FOREIGN PATENT DOCUMENTS

| | | | |
|---|---|---|---|
| JP | 2002-104696 | A | 4/2002 |
| JP | 4006354 | B2 | 11/2007 |

* cited by examiner

IMAGE FORMING APPARATUS

CROSS-REFERENCE TO RELATED APPLICATION

This application claims priority under 35 U.S.C. §119 from Japanese Patent Application No. 2014-162636 filed on Aug. 8, 2014. The entire subject matter of the application is incorporated herein by reference.

BACKGROUND

Technical Field

The following description relates to one or more aspects of an image forming apparatus configured to form an image on a sheet.

Related Art

An image forming apparatus has been known that includes an image forming unit, a conveyance roller, and registration rollers. In order to compensate a decrease in a sheet conveyance velocity caused by wear of the registration rollers, the known image forming apparatus is configured to increase a rotational frequency of a driving source for driving the registration rollers, in accordance with an increase in a cumulative period of rotating time or a cumulative number of rotations of the registration rollers.

SUMMARY

The registration rollers have at least a function as correction rollers for performing skew correction for a sheet to be supplied to the image forming unit. The skew correction is performed in accordance with the following procedure.

Specifically, for instance, in a state where rotation of a pair of correction rollers is stopped, a leading end of a sheet in a conveyance direction comes into contact with the correction rollers. Then, the correction rollers resume being rotated after a lapse of a predetermined period of time (hereinafter referred to as a "stop time") since the rotation of the correction rollers has been stopped.

In the meantime, as the wear of the conveyance roller progresses, the sheet conveyance velocity decreases. Therefore, a period of time (hereinafter referred to as a "contact time") during which the leading end of the sheet in the conveyance direction is substantially in contact with the correction rollers becomes shorter. If the contact time becomes too shorter, the correction rollers might not adequately perform the skew correction.

Further, when a driving force is supplied from the single common driving source to the conveyance roller and the correction rollers, it is not possible to independently control only the rotational frequency of the worn conveyance roller. Therefore, it is difficult to prevent occurrence of inadequately-performed skew correction.

Aspects of the present disclosure are advantageous to provide one or more improved techniques that make it possible to prevent occurrence of inadequately-performed skew correction in an image forming apparatus configured to supply a driving force from a single driving source to a conveyance roller and a registration roller.

According to aspects of the present disclosure, an image forming apparatus is provided that includes an image forming unit configured to form an image on a sheet, a conveyance roller configured to convey the sheet in a conveyance direction toward the image forming unit, a registration roller disposed downstream of the conveyance roller and upstream of the image forming unit in the conveyance direction, the registration roller being configured to perform skew correction for the sheet to be conveyed to the image forming unit, by contacting a leading end of the sheet in the conveyance direction in a state where rotation of the registration roller is being stopped, and rotating after a lapse of a particular period of time since the rotation of the registration roller has been stopped, a driving source configured to supply a driving force to the conveyance roller and the registration roller, and a controller configured to determine the particular period of time based on a cumulative number of sheets conveyed by the conveyance roller.

According to aspects of the present disclosure, further provided is an image forming apparatus that includes an image forming unit configured to form an image on a sheet, a conveyance roller configured to convey the sheet in a conveyance direction toward the image forming unit, a downstream sheet detector disposed downstream of the conveyance roller in the conveyance direction, the downstream sheet detector being configured to output a signal according to whether the downstream sheet detector detects the sheet, a registration roller disposed downstream of the downstream sheet detector and upstream of the image forming unit in the conveyance direction, a driving source configured to supply a driving force to the conveyance roller and the registration roller, and a controller configured to perform a skew correction process including feeding the sheet by rotating the conveyance roller, in response to the downstream sheet detector detecting the sheet, stopping rotation of the registration roller and causing a leading end of the sheet in the conveyance direction to contact the stopped registration roller, and starting rotation of the registration roller after a lapse of a particular period of time since the rotation of the registration roller has been stopped, and conveying the sheet in the conveyance direction by the registration roller, and a determining process including determining the particular period of time based on a cumulative number of sheets conveyed by the conveyance roller.

According to aspects of the present disclosure, further provided is an image forming apparatus that includes an image forming unit configured to form an image on a sheet, a conveyance roller configured to convey the sheet in a conveyance direction toward the image forming unit, an upstream sheet detector disposed upstream of the conveyance roller in the conveyance direction, the upstream sheet detector being configured to output a signal according to whether the upstream sheet detector detects the sheet, a downstream sheet detector disposed downstream of the conveyance roller in the conveyance direction, the downstream sheet detector being configured to output a signal according to whether the downstream sheet detector detects the sheet, a registration roller disposed downstream of the downstream sheet detector and upstream of the image forming unit in the conveyance direction, the registration roller being configured to perform skew correction for the sheet to be conveyed to the image forming unit, by contacting a leading end of the sheet in the conveyance direction during a particular period of time when rotation of the registration roller is being stopped, a driving source configured to supply a driving force to the conveyance roller and the registration roller, a clutch mechanism disposed on a transmission path to transmit the driving force from the driving source to the registration roller, the clutch mechanism being configured to, when engaged, permit the transmission of the driving force to the registration roller, and when disengaged, interrupt the transmission of the driving force to the registration roller, and a controller configured to, in response to the upstream sheet detector detecting the sheet, increment a cumulative number of sheets conveyed by the conveyance roller, in response to the downstream sheet detector detecting the sheet, disengage the clutch mechanism and stop rotation of the registration roller, determine the particular period of time based on the cumulative number of sheets conveyed by the conveyance roller, after a lapse of the particular period of time since the downstream sheet detector has detected the sheet, engage the clutch mechanism and rotate the registration roller.

BRIEF DESCRIPTION OF THE ACCOMPANYING DRAWINGS

DETAILED DESCRIPTION

Figure 1:
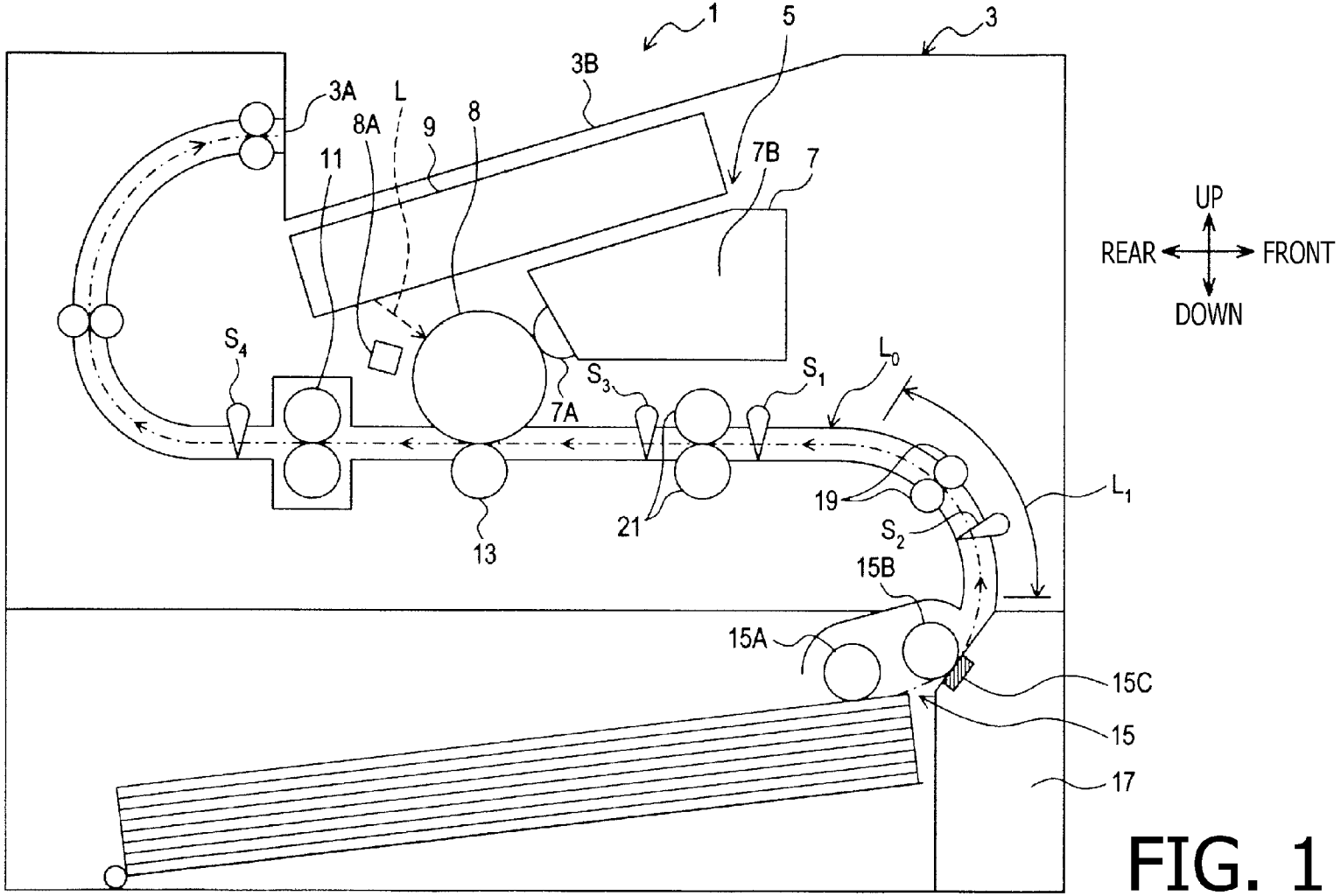
FIG. 1 is a cross-sectional side view of an image forming apparatus in accordance with one or more aspects of the present disclosure.

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, illustrative embodiments according to aspects of the present disclosure will be described with reference to the accompanying drawings. In the illustrative embodiments, aspects of the present disclosure are applied to an electrophotographic image forming apparatus. It is noted that arrows are provided to show directions in the drawings for the sake of easy understanding of interrelation between the drawings.

Nonetheless, the arrows provided in the drawings are not intended to be limiting the present disclosure. It is noted that with respect to each element identified by a reference character in the present disclosure, at least one of the identified element, unless specified otherwise, may be provided.

First Illustrative Embodiment

1. Overview of Image Forming Apparatus 1.1. Outline of Configuration

As shown in FIG. 1, an image forming apparatus 1 includes an image forming unit 5 inside a housing 3. The image forming unit 5 is configured to form an image on a sheet in a monochrome method, and includes a development cartridge 7, a photoconductive drum 8, an exposure unit 9, and a fuser unit 11.

A discharge port 3A and a discharge tray 3B are disposed at an upper portion of the housing 3. The discharge port 3A is configured such that a sheet with an image formed thereon is discharged therethrough. The discharge tray 3B is configured to receive the sheet discharged through the discharge port 3A.

The development cartridge 7 includes a development roller 7A and a developer container 7B. The photoconductive drum 8 is configured to carry a developer image. A charger 8A is configured to charge the photoconductive drum 8. The exposure unit 9 is configured to expose the charged photoconductive drum 8. Thereby, an electrostatic latent image is formed on the photoconductive drum 8. In the first illustrative embodiment, for instance, the exposure unit 9 is configured to expose the photoconductive drum 8 by scanning the photoconductive drum 8 with laser light L.

The development roller 7A is configured to supply the photoconductive drum 8 with developer stored in the developer container 7B. Thereby, a developer image is formed on the photoconductive drum 8. There is a transfer unit 13 disposed in a position to face the photoconductive drum 8.

The transfer unit 13 is configured to transfer onto a sheet the developer image carried on the photoconductive drum 8. The fuser unit 11 is configured to directly or indirectly heat the developer image transferred onto the sheet and fix the developer image onto the sheet. A feeder mechanism 15 is disposed upstream of the image forming unit 5 (including the transfer unit 13) in a conveyance direction.

The feeder mechanism 15 is configured to convey sheets placed on a feed tray 17 on a sheet-by-sheet basis toward the image forming unit 5. The feed tray 17 is configured to support one or more sheets stacked thereon. The feed tray 17 is detachably attached to an apparatus main body.

The apparatus main body represents a portion that includes the housing 3 and a frame (not shown) and is not broken down when a user uses the image forming apparatus 1. The user is allowed to attach and detach the feed tray 17 relative to the apparatus main body by moving the feed tray 17 back and forth.

The feeder mechanism 15 includes a pickup roller 15A, a separation roller 15B, and a separation pad 15C. The pickup roller 15A is configured to come into contact with the one or more sheets placed on the feed tray 17 from above, and feed the one or more sheets to the image forming unit 5.

The separation roller 15B and the separation pad 15C form a separation mechanism configured to, when two or more mutually-overlapping sheets are fed out from the pickup roller 15A, separate and convey the sheets on a sheet-by-sheet basis toward the image forming unit 5.

A sheet fed out from the feed tray 17 by the feeder mechanism 15 is supplied to the image forming unit 5, more specifically, to the photoconductive drum 8, by a pair of conveyance rollers 19 and a pair of registration rollers 21. The two registration rollers 21 are disposed to face each other across a conveyance path extending from the two conveyance rollers 19 to the photoconductive drum 8.

The two registration rollers 21 are configured to perform skew correction for the sheet and adjust timing to supply the sheet to the photoconductive drum 8.

Specifically, the two registration rollers 21 are configured to, when their rotation is being stopped, come into contact with a leading end of the sheet in the conveyance direction, and then resume rotating. The two conveyance rollers 19 continue to rotate even when the rotation of the two registration rollers 21 is being stopped.

The leading end in the conveyance direction of the sheet, which is conveyed by the two conveyance rollers 19 toward the registration rollers 21, collides against the two registration rollers 21 of which the rotation is being stopped.

Thereby, the posture of the sheet is corrected such that the leading end of the sheet in the conveyance direction becomes along an outer circumferential surfaces of the two registration rollers 21. Thereafter, when the two registration rollers 21 begin to rotate, the sheet is supplied to the image forming unit 5.

Figure 2:
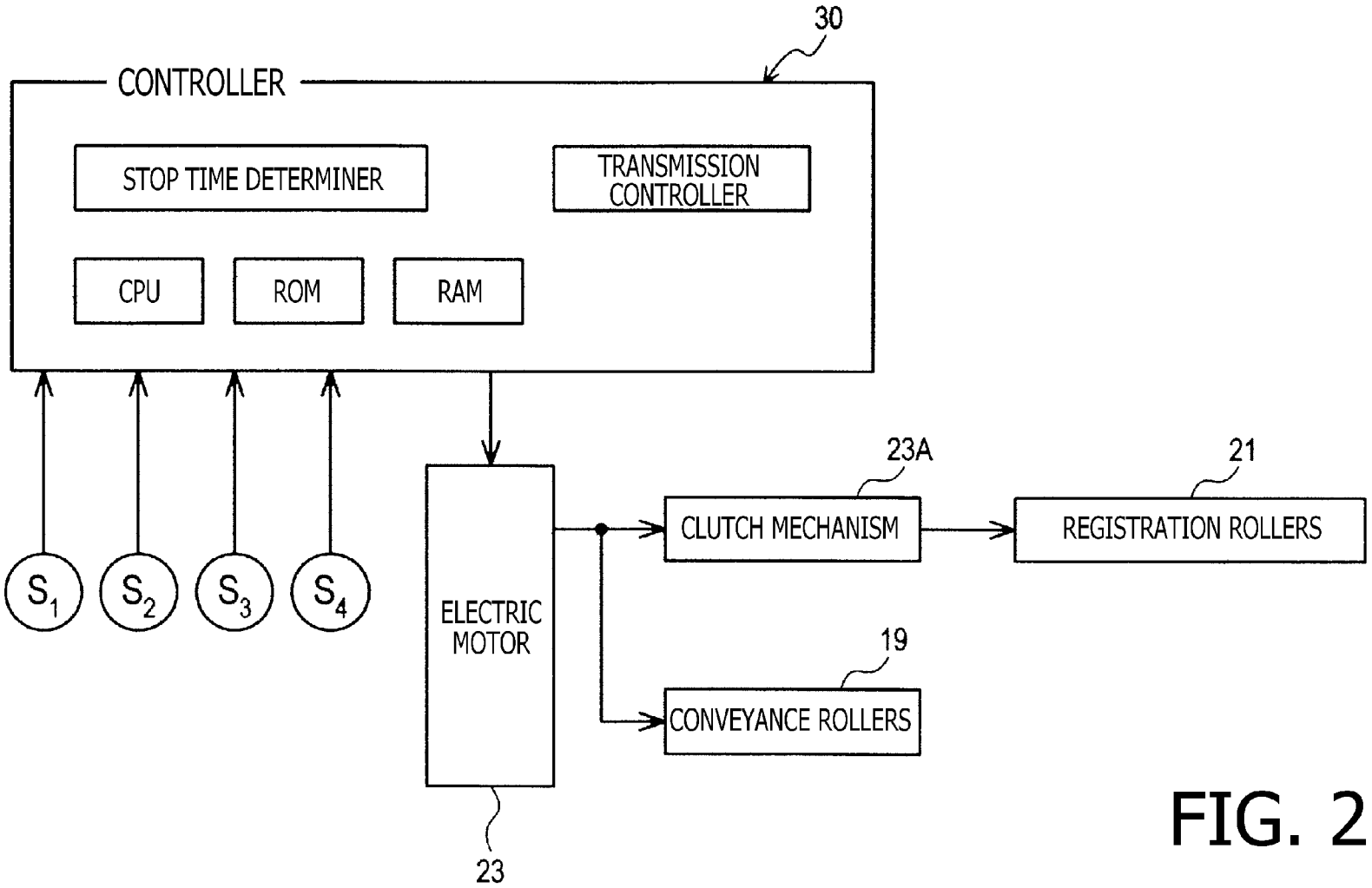
FIG. 2 is a block diagram schematically showing a control system of the image forming apparatus in accordance with one or more aspects of the present disclosure.

As shown in FIG. 2, the two conveyance rollers 19 and the two registration rollers 21 are supplied with a driving force from a single common driving source (in the first illustrative embodiment, an electric motor 23). On a transmission path of the driving force from the electric motor 23 to the two registration rollers 21, a clutch mechanism 23A is disposed.

The clutch mechanism 23A is configured to permit and interrupt transmission of the driving force. Therefore, when the transmission path is disconnected by the clutch mechanism 23A in a state where the electric motor 23 is rotating, the rotation of the two registration rollers 21 is stopped. When the transmission path is connected by the clutch mechanism 23A in the state where the electric motor 23 is rotating, the two registration rollers 21 begin to rotate.

As shown in FIG. 1, a conveyance path Lo extending from the feed tray 17 to the image forming unit 5 (the photoconductive drum 8) is curved substantially in a J-shape so as to turn around the conveyance direction of the sheet fed out from the feeder mechanism 15 substantially by 180 degrees. The two conveyance rollers 19 are disposed at a curved portion L1 of the conveyance path Lo. The curved portion L1 is largely curved (by substantially 180 degrees).

Along the conveyance path Lo, at least a first sheet detector $S_1$ and a second sheet detector $S_2$ are disposed. The first sheet detector $S_1$ is disposed in a first position on a conveyance path extending from the conveyance rollers 19 to the registration rollers 21. The first sheet detector $S_1$ is configured to output a signal according to whether a sheet exists in the first position.

The second sheet detector $S_2$ is disposed in a second position upstream of the two conveyance rollers 19 in the conveyance direction. The second sheet detector $S_2$ is configured to output a signal according to whether a sheet exists in the second position. For instance, each of the first and second sheet detectors $S_1$ and $S_2$ may be configured to output a Lo signal when a sheet exists in the corresponding position, and output a Hi signal when a sheet does not exist in the corresponding position.

In general, the first sheet detector $S_1$ is disposed just before the two registration rollers 21. Therefore, immediately after (substantially at the same time when) the first sheet detector $S_1$ detects a sheet, a leading end of the sheet in the conveyance direction reaches the two registration rollers 21. Hence, the first sheet detector $S_1$ may be referred to as a "before-registration sensor."

When the sheet fed out from the feeder mechanism 15 is conveyed to the image forming unit 5 without being jammed, the second sheet detector $S_2$ detects a trailing end of the sheet in the conveyance direction (the output signal from the second sheet detector $S_2$ changes from Lo to Hi) after a lapse of a particular period of time since the second sheet detector $S_2$ has detected the leading end of the sheet in the conveyance direction (the output signal from the second sheet detector $S_2$ has changed from Hi to Lo). Hence, the second sheet detector $S_2$ may be referred to as a "trailing end sensor."

Further, a third sheet detector $S_3$ is disposed in a third position just behind the two registration rollers 21. The third sheet detector $S_3$ is configured to output a signal according to whether a sheet exists in the third position. Moreover, a fourth sheet detector $S_4$ is disposed in a fourth position just behind the fuser unit 11. The fourth sheet detector $S_4$ is configured to output a signal according to whether a sheet exists in the fourth position. Each of the first to fourth sheet detectors $S_1$ to $S_4$ is an optical sensor using a photo-interrupter (not shown).

1.2 Control System

As shown in FIG. 2, the signals output from the first to fourth sheet detectors $S_1$ to $S_4$ are transmitted to a controller 30. The controller 30 is configured to control the electric motor 23 and the clutch mechanism 23A, using the signals output from the first sheet detector $S_1$ and the second sheet detector $S_2$.

More specifically, the controller 30 includes a stop time determiner and a transmission controller. The stop time determiner is configured to determine a period of time to interrupt transmission of the driving force from the electric motor 23 to the two registration rollers 21, i.e., determine a period of time (hereinafter referred to as a stop time Ts) to stop rotation of the two registration rollers 21. The transmission controller is configured to instruct the clutch mechanism 23A to connect or disconnect the transmission path.

In the first illustrative embodiment, the controller 30 includes a CPU, a ROM, and a RAM and is configured to, when executing programs (software) previously stored in a non-volatile memory such as the ROM, control each of elements included in the image forming apparatus 1. Thus, the stop time determiner and the transmission controller are implemented by software.

2. Control of Clutch Mechanism

<Overview>

When the first sheet detector $S_1$ detects a sheet, the controller 30 interrupts the transmission path of the driving force from the electric motor 23 to the two registration rollers 21, and stops the rotation of the two registration rollers 21.

Then, when the rotation of the registration rollers 21 is stopped, i.e., when the stop time Ts has elapsed since the first sheet detector $S_1$ detected the sheet, the controller 30 connects the transmission path and resumes rotating the registration rollers 21.

Figure 3:
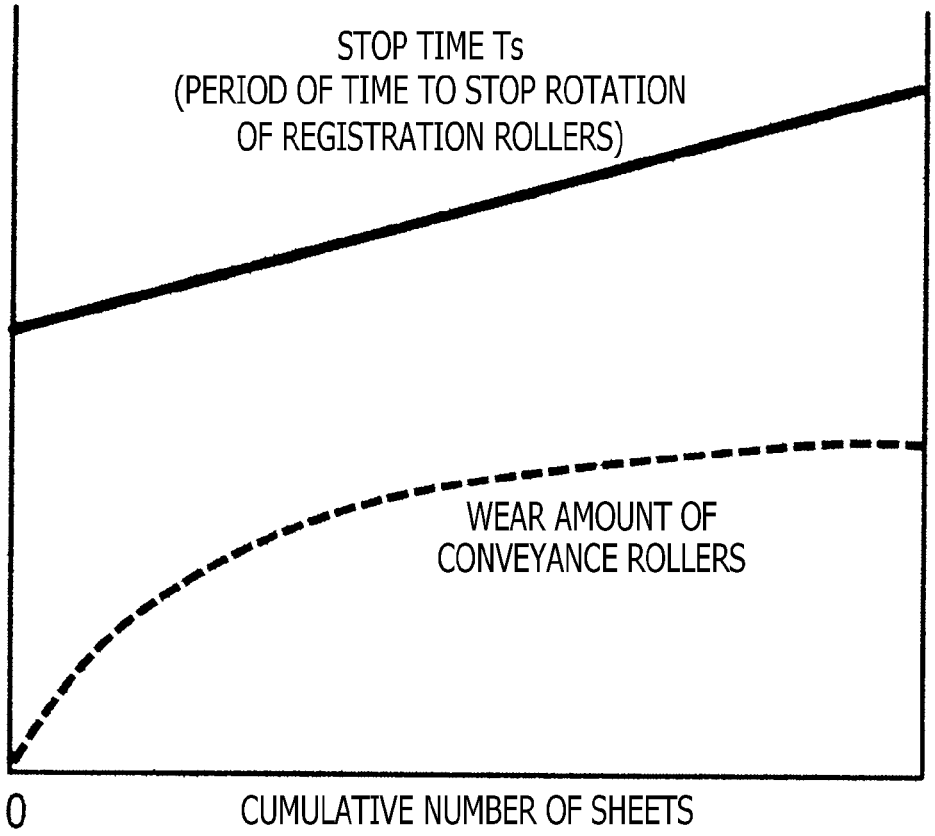
FIG. 3 shows a relationship between a stop time and a wear amount of conveyance rollers that vary depending on a cumulative number of sheets conveyed by the conveyance rollers in a first illustrative embodiment according to one or more aspects of the present disclosure.

The controller 30 determines the stop time Ts, using a cumulative number of sheets conveyed by the two conveyance rollers 19. Specifically, as shown in FIG. 3, the controller 30 determines the stop time Ts to continuously become longer as the cumulative number of the conveyed sheets increases. The relationship between the cumulative number of the conveyed sheets and the stop time Ts as shown in FIG. 3 is previously stored in the non-volatile memory such as the ROM.

The controller 30 counts the cumulative number of the conveyed sheets, using the output signal from the second sheet detector $S_2$. Namely, the controller 30 counts the number of changes from Lo to Hi in the output signal from the second sheet detector $S_2$, and stores the counted number into the non-volatile memory such as the ROM.

<Details>

Figure 4:
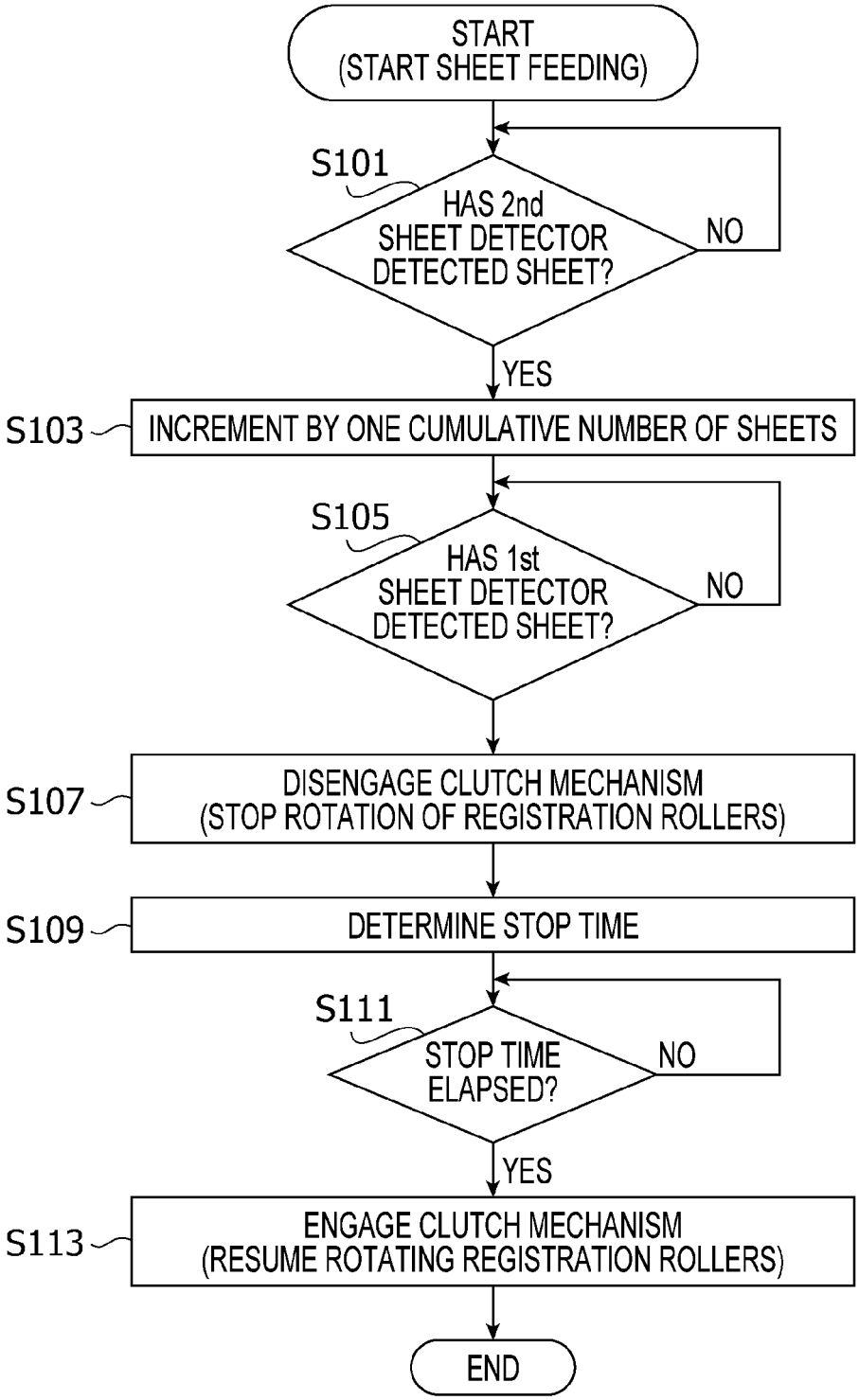
FIG. 4 is a flowchart showing a procedure of a control process to control a clutch mechanism in the first illustrative embodiment according to one or more aspects of the present disclosure.

FIG. 4 is a flowchart showing a detailed procedure of a control process to control the clutch mechanism 23A. A control program for executing the control process is previously stored in the non-volatile memory such as the ROM. When a sheet begins to be fed by the feeder mechanism 15, the control program is loaded into the RAM of the controller 30, and the control process shown in FIG. 4 is executed by the CPU of the controller 30. FIG. 4 exemplifies a control process for conveying a single sheet.

When the control process is launched, the controller 30 (the CPU) determines whether the second sheet detector $S_2$ has detected a leading end of a sheet in the conveyance direction (S101). While determining that the second sheet detector $S_2$ has not detected a leading end of a sheet in the conveyance direction (S101: No), the controller 30 repeatedly makes the determination in S101.

When determining that the second sheet detector $S_2$ has detected a leading end of a sheet in the conveyance direction (S101: Yes), the controller 30 increments by one the cumulative number of the conveyed sheets (S103). Thereafter, the controller 30 determines whether the first sheet detector $S_1$ has detected the leading end of the sheet in the conveyance direction (S105).

While determining that the first sheet detector $S_1$ has not detected the leading end of the sheet in the conveyance direction (S105: No), the controller 30 repeatedly makes the determination in S105. When determining that the first sheet detector $S_1$ has detected the leading end of the sheet in the conveyance direction (S105: Yes), the controller 30 disengages the clutch mechanism 23A and interrupts the transmission path of the driving force (S107). Thereby, the rotation of the two registration rollers 21 is stopped.

Then, the controller 30 determines the stop time Ts on the basis of the cumulative number of the conveyed sheets (S109). After that, the controller 30 determines whether the stop time Ts has elapsed since the clutch mechanism 23A was disengaged (since the first sheet detector $S_1$ detected the leading end of the sheet in the conveyance direction) (S111).

While determining that the stop time Ts has not elapsed since the clutch mechanism 23A was disengaged (S111: No), the controller 30 repeatedly makes the determination in S111. When determining that the stop time Ts has elapsed since the clutch mechanism 23A was disengaged (S111: Yes), the controller 30 engages the clutch mechanism 23A to connect the transmission path of the driving force (S113). Thereby, the two registration rollers 21 resume rotating.

3. Features of Image Forming Apparatus in First Illustrative Embodiment

In the first illustrative embodiment, the stop time Ts is determined using the cumulative number of the sheets conveyed by the conveyance rollers 19. Therefore, even when the wear of the conveyance rollers 19 progresses, it is possible to ensure an adequate contact time (i.e., an adequate period of time during which the leading end of the sheet in the conveyance direction is substantially in contact with the registration rollers 21). Accordingly, it is possible to prevent occurrence of inadequately-performed skew correction.

In the first illustrative embodiment, the two conveyance rollers 19 are disposed at the curved portion L1 of the conveyance path Lo that is largely curved (by substantially 180 degrees). Further, outer circumferential surfaces, which contact the sheet, of the two conveyance rollers 19 are made of a material (e.g., rubber) having a large frictional coefficient. Therefore, the two conveyance rollers 19 are likely to be easily worn.

Accordingly, in the first illustrative embodiment, by changing the stop time Ts using the cumulative number of the sheets conveyed by the conveyance rollers 19, it is possible to more effectively prevent occurrence of inadequately-performed skew correction.

Second Illustrative Embodiment

Figure 5:
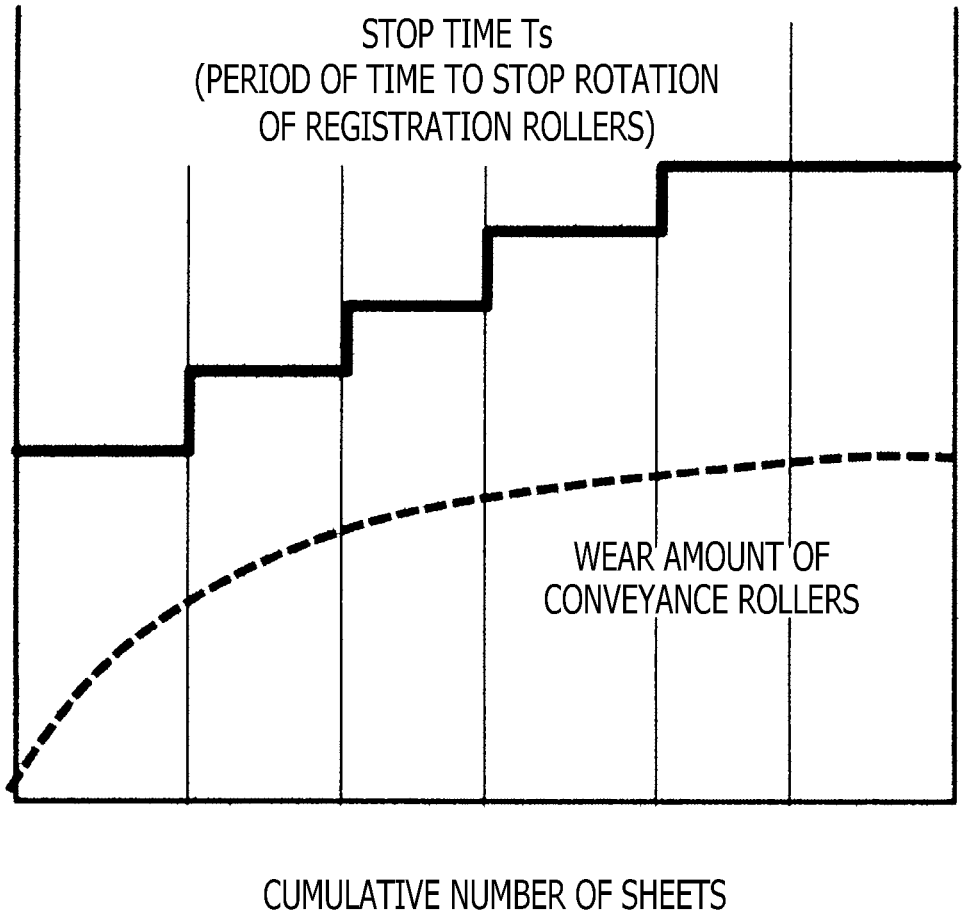
FIG. 5 shows a relationship between the stop time and the wear amount of conveyance rollers that vary depending on the cumulative number of sheets conveyed by the conveyance rollers in a second illustrative embodiment according to one or more aspects of the present disclosure.

In a second illustrative embodiment, as shown in FIG. 5, the stop time Ts is made longer in stages as the cumulative number of the conveyed sheets increases. The relationship between the cumulative number of the conveyed sheets and the stop time Ts as shown in FIG. 5 is previously stored in the non-volatile memory such as the ROM. It is noted that any number of stages may be acceptable in making the stop time Ts longer in stages.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

Modification

In the aforementioned illustrative embodiments, the cumulative number of sheets is counted using the output signal from the second sheet detector $S_2$. Nonetheless, the cumulative number of sheets may be counted, e.g., using the number of sheets identified by print instructions or the number of sheets detected by the first sheet detector $S_1$.

In the aforementioned illustrative embodiments, the point of time at which the first sheet detector $S_1$ detects the leading end of the sheet in the conveyance direction is coincident with the point of time to stop the rotation of the two registration rollers 21.

Nonetheless, for instance, the point of time to stop the rotation of the two registration rollers 21 may be slightly later than the point of time at which the first sheet detector $S_1$ detects the leading end of the sheet in the conveyance direction. Alternatively, the point of time to stop the rotation of the two registration rollers 21 may be after a lapse of a predetermined period of time from the point of time at which the second sheet detector $S_2$ has detected the leading end of the sheet in the conveyance direction.

In the aforementioned illustrative embodiments, aspects of the present disclosure are applied to the monochrome electrophotographic image forming apparatus. Nonetheless, aspects of the present disclosure may be applied to a color electrophotographic image forming apparatus.

What is claimed is:

1. An image forming apparatus comprising:

an image forming unit configured to form an image on a sheet;

a conveyance roller configured to convey the sheet in a conveyance direction toward the image forming unit;

a downstream sheet detector disposed downstream of the conveyance roller in the conveyance direction, the downstream sheet detector being configured to output a signal according to whether the downstream sheet detector detects the sheet;

a registration roller disposed downstream of the downstream sheet detector and upstream of the image forming unit in the conveyance direction;

a driving source configured to supply a driving force to the conveyance roller and the registration roller;

an upstream sheet detector disposed upstream of the conveyance roller in the conveyance direction, the upstream sheet detector being configured to output a signal according to whether the upstream sheet detector detects the sheet;

a controller configured to perform:

a skew correction process comprising:

feeding the sheet by rotating the conveyance roller;

in response to the downstream sheet detector detecting the sheet, stopping rotation of the registration roller and causing a leading end of the sheet in the conveyance direction to contact the stopped registration roller; and starting rotation of the registration roller after a lapse of a particular period of time since the rotation of the registration roller has been stopped, and conveying the sheet in the conveyance direction by the registration roller; and a determining process comprising:

counting the cumulative number of sheets conveyed by the conveyance roller, using the signal output from the upstream sheet detector, and determining the particular period of time based on the cumulative number of sheets conveyed by the conveyance roller.

2. The image forming apparatus according to claim 1, wherein the determining process further comprises determining the particular period of time to become longer as the cumulative number of sheets conveyed by the conveyance roller increases.

3. The image forming apparatus according to claim 2, wherein the determining process further comprises determining the particular period of time to continuously become longer as the cumulative number of sheets conveyed by the conveyance roller increases.

4. The image forming apparatus according to claim 2, wherein the determining process further comprises determining the particular period of time to become longer in stages as the cumulative number of sheets conveyed by the conveyance roller increases.

5. The image forming apparatus according to claim 1, further comprising a clutch mechanism disposed on a transmission path to transmit the driving force from the driving source to the registration roller, the clutch mechanism being configured to, when engaged, transmit the driving force from the driving source to the registration roller, and when disengaged, interrupt the transmission of the driving force from the driving source to the registration roller, wherein the skew correction process further comprises:

stopping the rotation of the registration roller by disengaging the clutch mechanism; and starting the rotation of the registration roller by engaging the clutch mechanism.

6. The image forming apparatus according to claim 1, further comprising a feed tray configured to support one or more sheets placed thereon, wherein the conveyance roller is disposed at a curved portion of a conveyance path extending from the feed tray to the image forming unit, the curved portion being curved to turn around the conveyance direction of each sheet fed out from the feed tray, toward the image forming unit.

7. An image forming apparatus comprising:

an image forming unit configured to form an image on a sheet;

a conveyance roller configured to convey the sheet in a conveyance direction toward the image forming unit;

an upstream sheet detector disposed upstream of the conveyance roller in the conveyance direction, the upstream sheet detector being configured to output a signal according to whether the upstream sheet detector detects the sheet;

a downstream sheet detector disposed downstream of the conveyance roller in the conveyance direction, the downstream sheet detector being configured to output a signal according to whether the downstream sheet detector detects the sheet;

a registration roller disposed downstream of the downstream sheet detector and upstream of the image forming unit in the conveyance direction, the registration roller being configured to perform skew correction for the sheet to be conveyed to the image forming unit, by contacting a leading end of the sheet in the conveyance direction during a particular period of time when rotation of the registration roller is being stopped;

a driving source configured to supply a driving force to the conveyance roller and the registration roller;

a clutch mechanism disposed on a transmission path to transmit the driving force from the driving source to the registration roller, the clutch mechanism being configured to, when engaged, permit the transmission of the driving force to the registration roller, and when disengaged, interrupt the transmission of the driving force to the registration roller; and a controller configured to:

in response to the upstream sheet detector detecting the sheet, increment a cumulative number of sheets conveyed by the conveyance roller;

in response to the downstream sheet detector detecting the sheet, disengage the clutch mechanism and stop rotation of the registration roller;

determine the particular period of time based on the cumulative number of sheets conveyed by the conveyance roller;

after a lapse of the particular period of time since the downstream sheet detector has detected the sheet, engage the clutch mechanism and rotate the registration roller.

8. The image forming apparatus according to claim 7, wherein the controller comprises:

a processor;

a memory storing processor-executable instructions configured to, when executed by the processor, cause the processor to:

in response to the upstream sheet detector detecting the sheet, increment the cumulative number of sheets conveyed by the conveyance roller;

in response to the downstream sheet detector detecting the sheet, disengage the clutch mechanism and stop rotation of the registration roller;

determine the particular period of time based on the cumulative number of sheets conveyed by the conveyance roller;

after a lapse of the particular period of time since the downstream sheet detector has detected the sheet, engage the clutch mechanism and rotate the registration roller.

9. The image forming apparatus according to claim 7, wherein the controller is further configured to determine the particular period of time to become longer as the cumulative number of sheets conveyed by the conveyance roller increases.

10. The image forming apparatus according to claim 9, wherein the controller is further configured to determine the particular period of time to continuously become longer as the cumulative number of sheets conveyed by the conveyance roller increases.

11. The image forming apparatus according to claim 9, wherein the controller is further configured to determine the particular period of time to become longer in stages as the cumulative number of sheets conveyed by the conveyance roller increases.

12. The image forming apparatus according to claim 7, further comprising a feed tray configured to support one or more sheets placed thereon, wherein the conveyance roller is disposed at a curved portion of a conveyance path extending from the feed tray to the image forming unit, the curved portion being curved to turn around the conveyance direction of each sheet fed out from the feed tray, toward the image forming unit.

* * * * *